US007339103B2

(12) United States Patent
Hilburn

(10) Patent No.: US 7,339,103 B2
(45) Date of Patent: Mar. 4, 2008

(54) PERCUSSION BEATER CAGE

(76) Inventor: Russell Hilburn, 17122 Barcelona, Friendswood, TX (US) 77546

( * ) Notice: Subject to any disclaimer, the term of this patent is extended or adjusted under 35 U.S.C. 154(b) by 281 days.

(21) Appl. No.: 11/141,233

(22) Filed: May 31, 2005

(65) Prior Publication Data

US 2006/0266199 A1 Nov. 30, 2006

(51) Int. Cl.
*G10D 13/02* (2006.01)

(52) U.S. Cl. ..... 84/422.1; 200/86.5

(58) Field of Classification Search ..... 84/422.1, 84/422.2, 422.3, 426, 723, 746; 200/86.5
See application file for complete search history.

(56) References Cited

U.S. PATENT DOCUMENTS

| | | | | |
|---|---|---|---|---|
| 6,545,204 | B1 | 4/2003 | Wadell | 84/422.1 |
| 6,570,078 | B2 | 5/2003 | Ludwig | 84/600 |
| 6,610,917 | B2 | 8/2003 | Ludwig | 84/726 |
| 6,645,067 | B1 | 11/2003 | Okita et al. | 463/7 |
| 6,684,734 | B2 | 2/2004 | Gatzen | 74/560 |
| 2004/0025667 | A1 * | 2/2004 | Hampton, Jr. | 84/426 |

* cited by examiner

*Primary Examiner*—Lincoln Donovan
*Assistant Examiner*—Jianchun Qin
(74) *Attorney, Agent, or Firm*—Derek R. Van Gilder

(57) ABSTRACT

A percussion beater cage has a first cage bar (1) positioned horizontally apart from a second cage bar (2) on at least one bar holder (3). The first cage bar is structured for attachment of a first acoustical trigger (5). The second cage bar is structured for attachment of a second acoustical trigger (6). The bar holder and optionally bar holders (12, 13, 32, 35) are structured for adjustable positioning of the first cage bar and the second cage bar a distance apart selectively for positioning the first acoustical trigger a desired strike-timing distance apart from the second acoustical trigger selectively. A base plate (4) is structured for attachment of a conventional foot pedal (7) for foot-actuating musical instruments that include base drums. The conventional foot pedals generally have a beater head (9) on a beater rod (8) actuated with the foot pedal for striking at least one acoustical trigger that is most commonly digital.

11 Claims, 6 Drawing Sheets

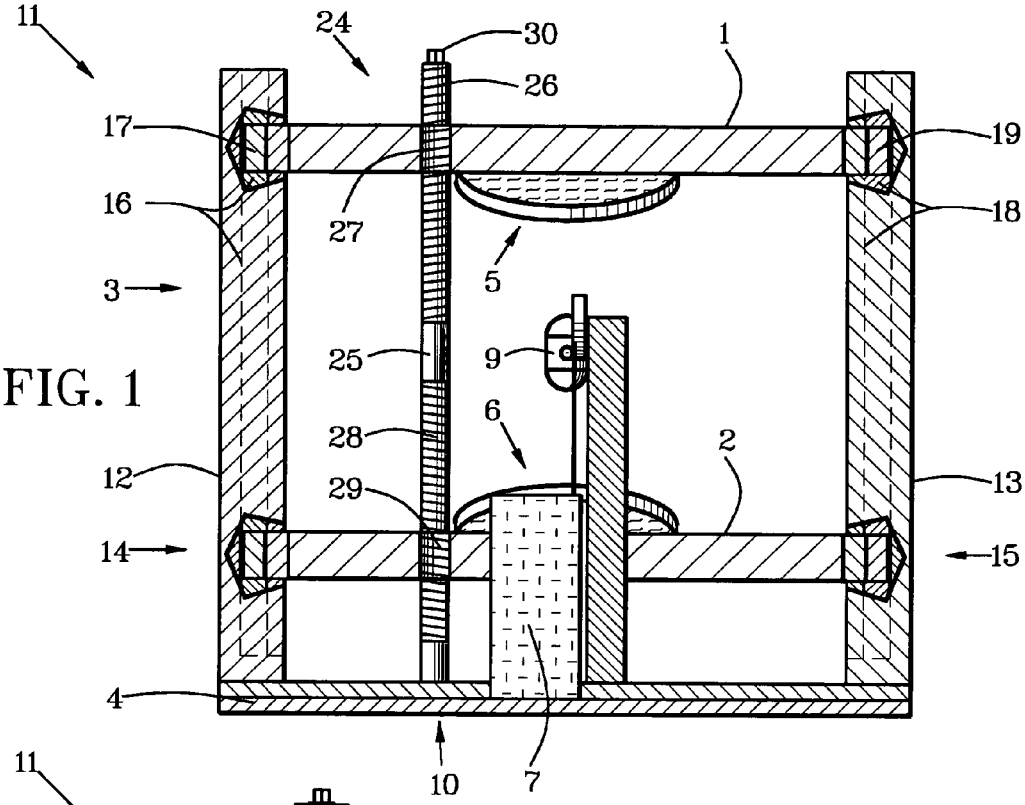
FIG. 1
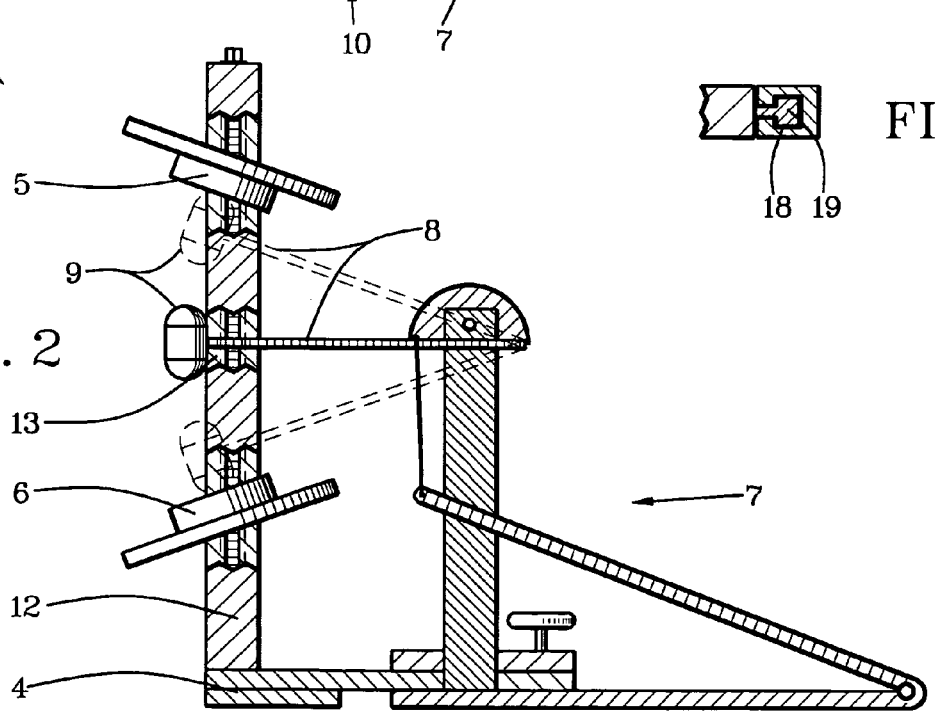
FIG. 2
FIG. 3

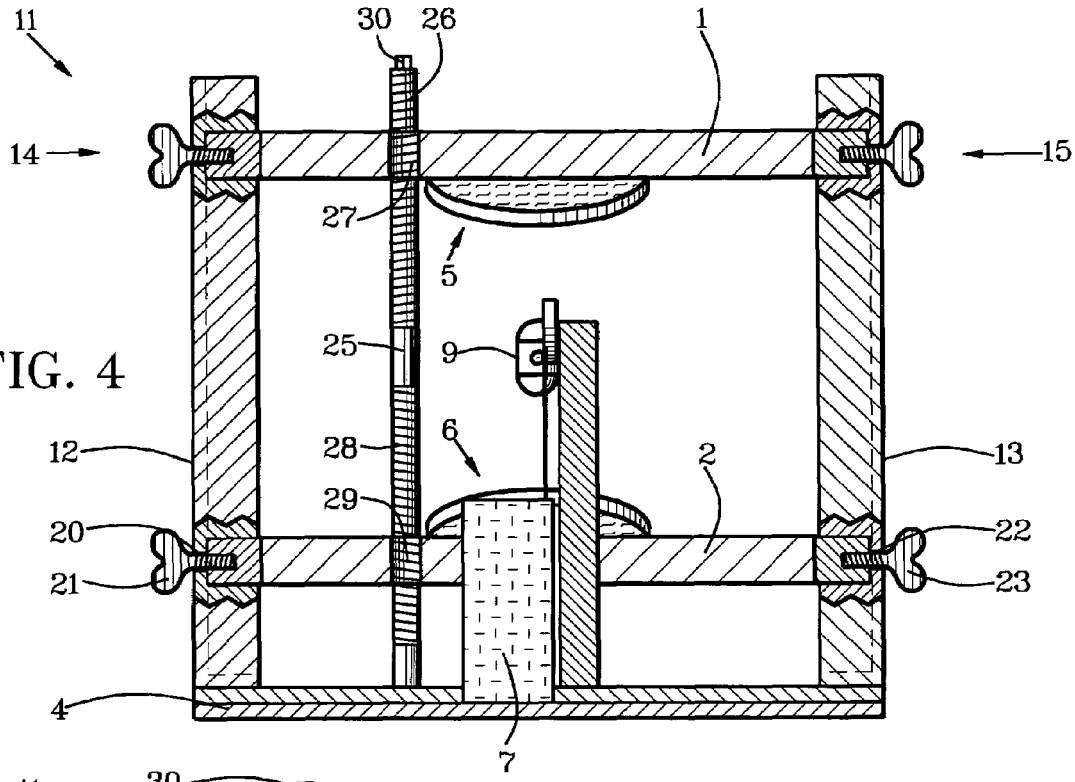
FIG. 4
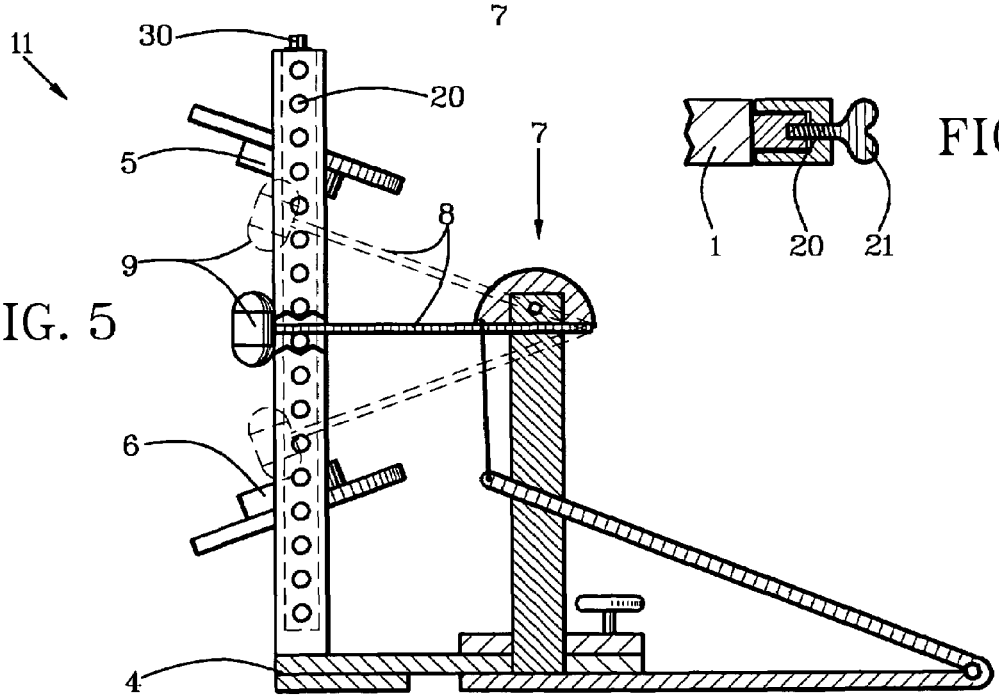
FIG. 5
FIG. 6

PERCUSSION BEATER CAGE

BACKGROUND OF THE INVENTION

1. Field of the Invention

This invention relates to cages for foot beaters of percussion instruments, particularly for control of foot-beater rate and cycling of foot beating of digital drums.

2. Relation to Prior Art

Foot beaters for percussion instruments, particularly for state-of-the-art digital drums, are well known. None, however, have distance caging of beater rods for controlling beat-triggering rate, cycle and impact of foot percussion-beater heads in a manner taught by this invention.

Related but different known prior art includes the following:

| Patent Number | Inventive Entity | Disclosure Date |
|---|---|---|
| U.S. Pat. No. 6,545,204 | Wadell | Apr. 8, 2003 |
| U.S. Pat. No. 6,570,078 | Ludwig | May 27, 2003 |
| U.S. Pat. No. 6,610,917 | Ludwig | Aug. 26, 2003 |
| U.S. Pat. No. 6,645,067 | Okita et al. | Nov. 11, 2003 |
| U.S. Pat. No. 6,684,734 | Gatzen | Feb. 3, 2004 |
| U.S. Pat. No. 6,689,947 | Ludwig | Feb. 10, 2004 |

SUMMARY OF THE INVENTION

Objects of patentable novelty and utility taught by this invention are to provide a percussion beater cage which:

allows a musician to foot-beat a percussion instrument within a wide range of speeds, impact force and cycles selectively;

allows dynamic, in-use or on-the-fly adjustment and alteration of speeds, impact force and cycles selectively;

can be switched between single-strike and double-strike operation while in use;

works with all known commercial foot pedals for percussion instruments;

is adaptable to use for a wide range of foot-operated musical instruments; and is conveniently small, light and easy to use.

This invention accomplishes these and other objectives with a percussion beater cage having a first cage bar positioned horizontally apart from a second cage bar on a first cage-bar riser and a second cage-bar riser extended vertically from a horizontal base plate. The first cage bar is structured for attachment of a first acoustical strike surface. The second cage bar is structured for attachment of a second acoustical strike surface. The first cage-bar riser and the second cage-bar riser are structured for adjustable positioning of the first cage bar and the second cage bar a distance apart selectively for positioning the first acoustical strike surface a desired strike-timing distance apart from the second acoustical strike surface selectively. The base plate is structured for attachment of a conventional foot pedal for foot-beating musical instruments. The conventional foot pedals generally have a beater head on a striker rod actuated with the foot pedal for striking at least one acoustical strike surface.

BRIEF DESCRIPTION OF DRAWINGS

This invention is described by appended claims in relation to description of a preferred embodiment with reference to the following drawings which are explained briefly as follows:

FIG. 1 is a partially cutaway front view of a vertical percussion beater cage having T-members in T-slots and a two-way adjuster;

FIG. 2 is a partially cutaway side view of the vertical percussion beater cage having the T-members in the T-slots and the two-way adjuster;

FIG. 3 is a fragmentary top view of the T-members in the T-slots;

FIG. 4 is a partially cutaway front view of the vertical percussion beater cage having fastener members in fastener apertures and the two-way adjuster;

FIG. 5 is a partially cutaway side view of the vertical percussion beater cage having the fastener apertures and the two-way adjuster;

FIG. 6 is a fragmentary top view of the fastener members in the fastener apertures;

DESCRIPTION OF PREFERRED EMBODIMENT

Figure 7:
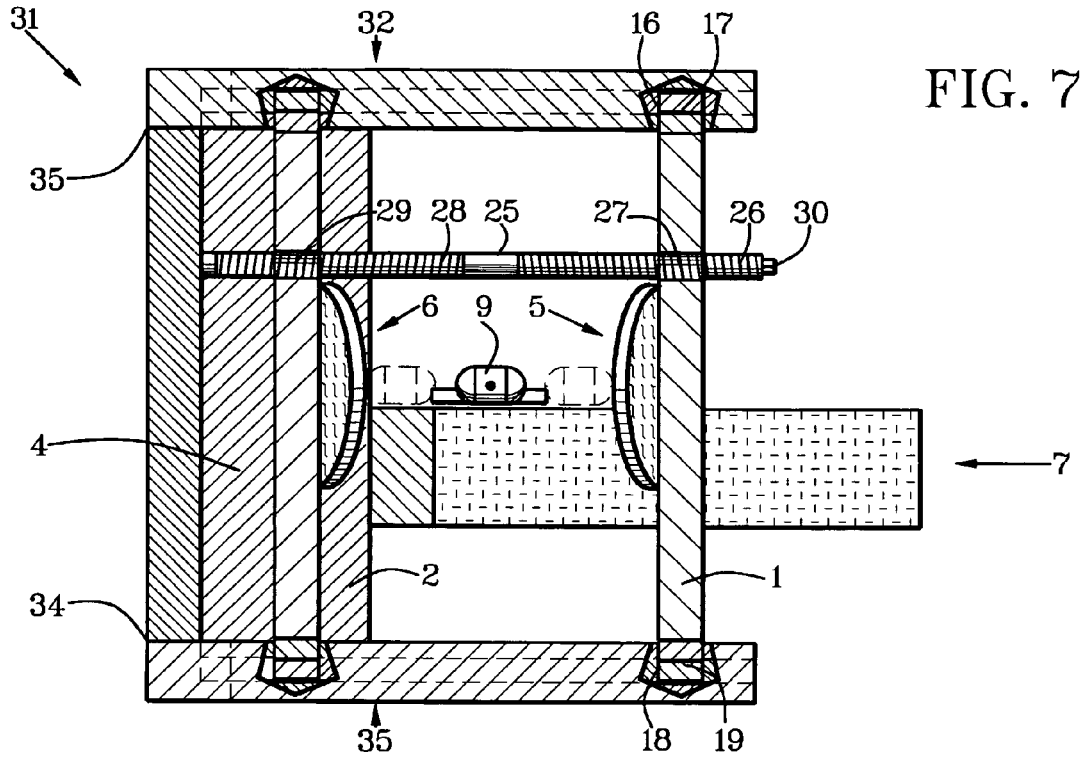
FIG. 7 is a partially cutaway top view of a horizontal percussion beater cage having T-members in the T-slots and the two-way adjuster.
Figure 8:
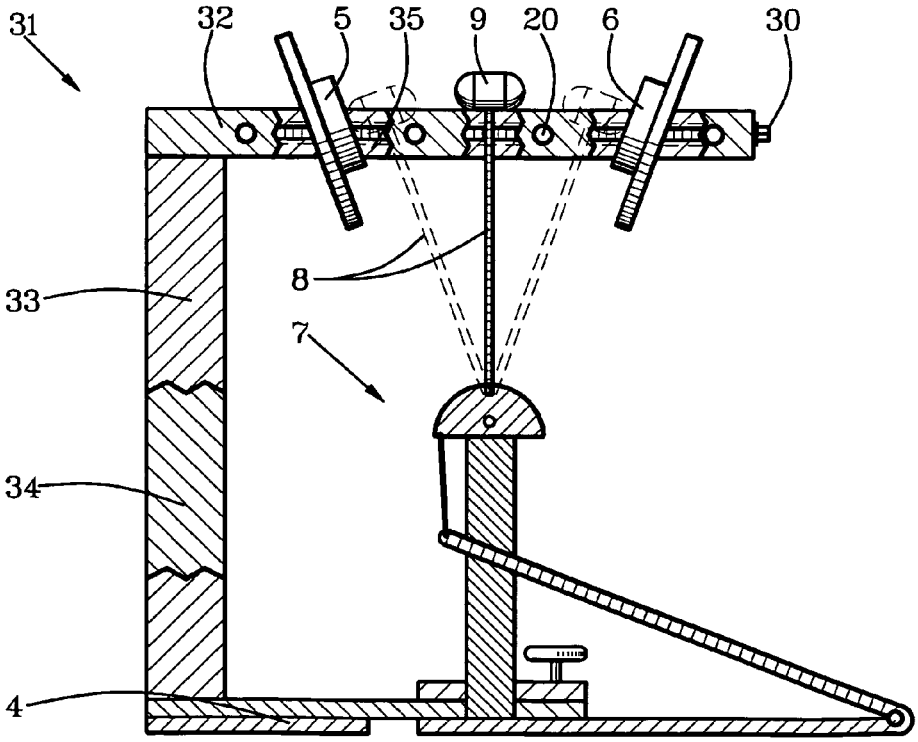
FIG. 8 is a partially cutaway side view of the horizontal percussion beater cage having the T-members in the T-slots and the two-way adjuster.
Figure 9:
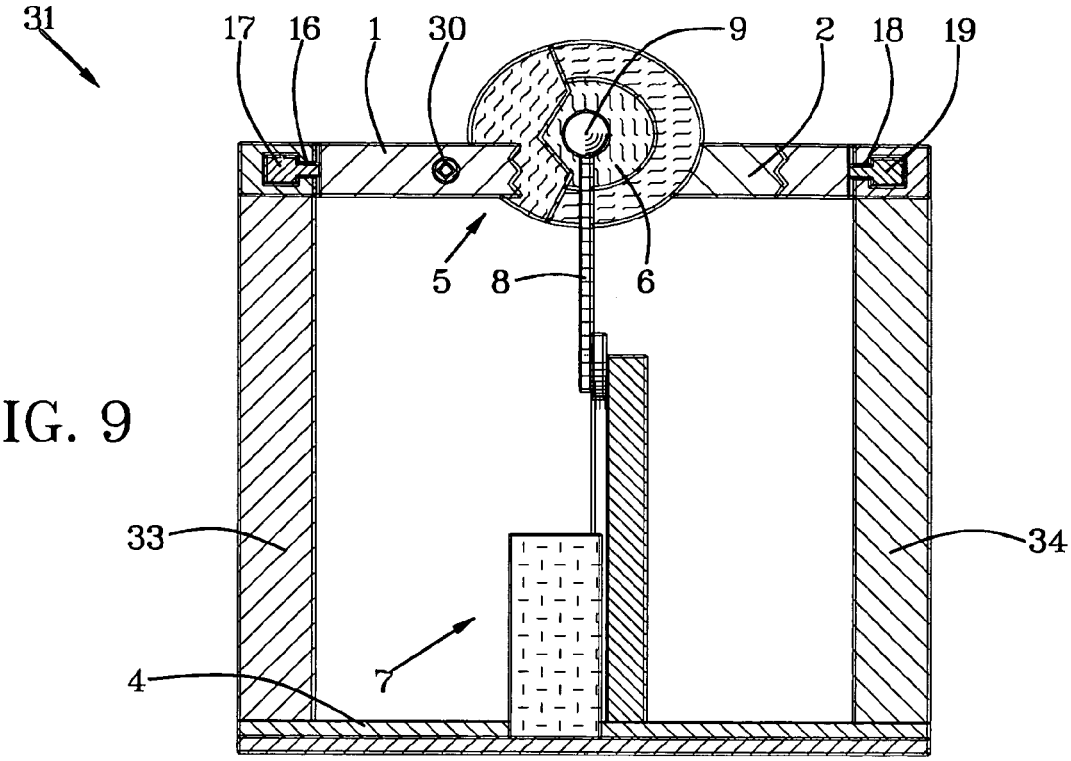
FIG. 9 is a partially cutaway front view of the horizontal percussion beater cage having the T-members in the T-slots and the two-way adjuster.
Figure 10:
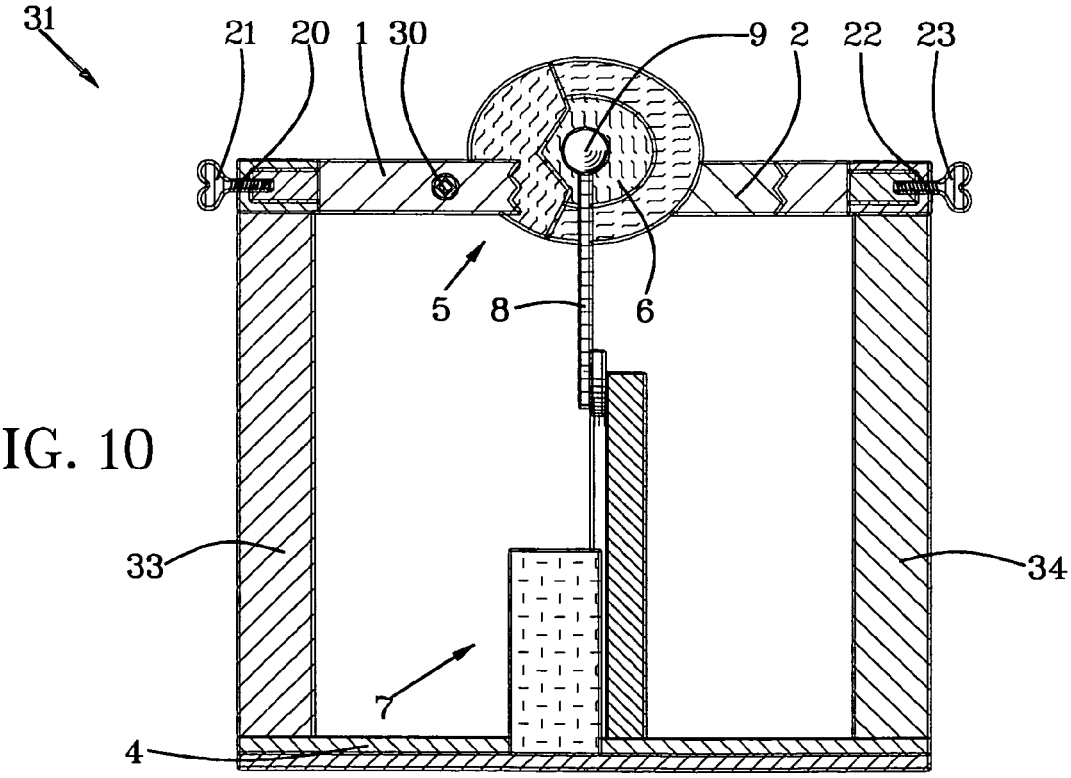
FIG. 10 is a partially cutaway front view of the horizontal percussion beater cage having the fastener members in the fastener apertures and the two-way adjuster.

A description of the preferred embodiment of this invention follows a list of numbered terms which designate its features with the same numbers on the drawings and in parentheses throughout the description and throughout the patent claims.

1. First cage bar
2. Second cage bar
3. Bar holder
4. Base plate
5. First acoustical trigger
6. Second acoustical trigger
7. Foot pedal
8. Beater rod
9. Beater head
10. Bar adjuster
11. Vertical cage
12. First vertical holder
13. Second vertical holder
14. First-end fastener -continued 15. Second-end fastener
16. First T-slot
17. First T-members
18. Second T-slot
19. Second T-members
20. First fastener apertures
21. First fastener members
22. Second fastener apertures
23. Second fastener members
24. Two-way adjuster
25. Counter-threaded bolt
26. First-directional bolt threads
27. First-directional hole threads
28. Second-directional bolt threads
29. Second-directional hole threads
30. Rotator connection
31. Horizontal cage
32. First horizontal holder
33. First upright
34. Second upright
35. Second horizontal holder
36. Beat connector Referring to FIGS. 1-12, the percussion beater cage has a first cage bar (1) and a second cage bar (2) spaced apart horizontally and attached orthogonally to at least one bar holder (3). The bar holder (3) is attached predeterminedly to a horizontal base plate (4).

The first cage bar (1) is structured for attachment of a first acoustical trigger (5). The second cage bar (2) is structured for attachment of a second acoustical trigger (6).

The base plate (4) is structured for attachment of a predetermined foot pedal (7) for actuating a beater rod (8) having a beater head (9) intermediate positions for the first acoustical trigger (5) and the second acoustical trigger (6) on the first cage bar (1) and the second cage bar (2) respectively. There is a wide selection of the foot pedals (7) on the market. This invention is adaptable to all of those currently known. Generally, they are made for impacting digital triggers that trigger impact of musical instruments that include base drums. Most are made to impact in optionally double mode for both up and down foot-actuation or adjustably down-only mode. Previously, however, there has been no caging for control of rate of impact or triggering of impact.

A bar adjuster (10) is structured for adjusting distance between the first cage bar (1) and the second cage bar (2) for adjustment of rate per time of impact or triggering.

Referring to FIGS. 1-3, the percussion beater cage can include a vertical cage (11) having a first vertical holder (12) and a second vertical holder (13) spaced apart vertically and attached orthogonally to the base plate (4). The first cage bar (1) and the second cage bar (2) are spaced apart horizontally and attached orthogonally to the first vertical holder (12) and to the second vertical holder (13).

The bar adjuster (10) includes a first-end fastener (14) on the first vertical holder (12) and a second-end fastener (15) on the second vertical holder (13). The first-end fastener (14) is structured for positioning first ends of the first cage bar (1) desired distances from first ends of the second cage bar (2) and the second-end fastener (15) is structured for positioning first ends of the second cage bar (2) desired distances from second ends of the second cage bar (2).

The first-end fastener (14) can include a first T-slot (16) for receiving first T-members (17) on the first ends of the first cage bar (1) and on the first ends of the second cage bar (2). The second-end fastener (15) can include a second T-slot (18) for receiving second T-members (19) on the second ends of the first cage bar (1) and on the second ends of the second cage bar (2).

Referring to FIGS. 4-6, the first-end fastener (14) can include a spaced-apart plurality of first fastener apertures (20) for receiving first fastener members (21) on the first ends of the first cage bar (1) and on the first ends of the second cage bar (2). The second-end fastener (15) can include a spaced-apart plurality of second fastener apertures (22) for receiving second fastener members (23) on the second ends of the first cage bar (1) and on the second ends of the second cage bar (2).

Referring further to FIGS. 1-12, the bar adjuster (10) can include a two-way adjuster (24) positioned predeterminedly on the first cage bar (1) and the second cage bar (2). The two-way adjuster (24) can include a counter-threaded bolt (25) having first-directional bolt threads (26) in threaded contact with first-directional hole threads (27) in the first cage bar (1). The counter-threaded bolt (25) has second-directional bolt threads (28) in threaded contact with second-directional hole threads (29) in the second cage bar (2). Preferably, the counter-threaded bolt (25) has a rotator connection (30) for attachment of motorized and manual rotators selectively.

Referring to FIGS. 1, 7-10 and 12, the percussion beater cage can include a horizontal cage (31) having a first horizontal holder (32) with a first end attached to a first upright (33). The horizontal cage (31) has a second horizontal holder (35) with a first end attached to the second upright (34).

The first upright (33) and the second upright (34) are attached to the base plate (4).

The first cage bar (1) and the second cage bar (2) are spaced apart horizontally and attached orthogonally to the first horizontal holder (32) and to the second horizontal holder (35).

The bar adjuster (10) can include the first horizontal holder (32) and the second horizontal holder (35).

The first horizontal holder (32) is structured for positioning first ends of the first cage bar (1) desired distances from first ends of the second cage bar (2). The second horizontal holder (35) is structured for positioning second ends of the first cage bar (1) desired distances from second ends of the second cage bar (2).

The first horizontal holder (32) can include the first T-slot (16) for receiving the first T-members (17) on the first ends of the first cage bar (1) and on the first ends of the second cage bar (2). The second horizontal holder (35) can include the second T-slot (18) for receiving the second T-members (19) on the second ends of the first cage bar (1) and on the second ends of the second cage bar (2).

The first horizontal holder (32) can include the spaced-apart plurality of the first fastener apertures (20) for receiving the first fastener members (21) on the first ends of the first cage bar (1) and on the first ends of the second cage bar (2). The second horizontal holder (35) can include the spaced-apart plurality of the second fastener apertures (22) for receiving the second fastener members (23) on the second ends of the first cage bar (1) and on the second ends of the second cage bar (2).

The bar adjuster (10) can include the two-way adjuster (24) positioned predeterminedly on the first cage bar (1) and the second cage bar (2).

The two-way adjuster (24) can include the counter-threaded bolt (25) having the first-directional bolt threads (26) in threaded contact with the first-directional hole threads (27) in the first cage bar (1). The counter-threaded bolt (25) has the second-directional bolt threads (28) in threaded contact with the second-directional hole threads (29) in the second cage bar (2).

Preferably for all embodiments, the counter-threaded bolt (25) has the rotator connection (30) for attachment of motorized and manual rotators selectively.

A method has the following steps for adjusting a percussion musical instrument for rate per time of foot-actuation:

providing a two-way adjuster (24) predeterminedly on a first cage bar (1) and a second cage bar (2); the two-way adjuster (24) includes a counter-threaded bolt (25);

the counter-threaded bolt (25) has first-directional bolt threads (26) in threaded contact with first-directional hole threads (27) in the first cage bar (1);

the counter-threaded bolt (25) has second-directional bolt threads (28) in threaded contact with second-directional hole threads (29) in the second cage bar (2);

providing the counter-threaded bolt (25) with a rotator connection (30) for attachment of motorized and manual rotators selectively; and rotating the counter-threaded bolt (25) with a rotator connection (30) for adjustment of the rate per time of foot-actuation.

The method can further include:

positioning the first cage bar (1) and the second cage bar (2) a predeterminedly adjustable distance apart horizontally on a percussion beater cage;

positioning a first acoustical trigger (5) on the first cage bar (1) and a second acoustical trigger (6) on the second cage bar (2);

positioning a beater head (9) of a beater rod (8) for beating the first acoustical trigger (5) and the second acoustical trigger (6) consecutively by foot-actuating a foot pedal (7) attached to a base plate (4) of the percussion beater cage;

decreasing distance between the first cage bar (1) and the second cage bar (2) to decrease distance between the first acoustical trigger (5) and the second acoustical trigger (6) for increasing rate per time of striking the first acoustical trigger (5) and the second acoustical trigger (6) by rotating the counter-threaded bolt (25) in a first rotational direction; and increasing distance between the first cage bar (1) and the second cage bar (2) to increase distance between the first acoustical trigger (5) and the second acoustical trigger (6) for decreasing rate per time of striking the first acoustical trigger (5) and the second acoustical trigger (6) by rotating the counter-threaded bolt (25) in a second rotational direction.

The method can further include:

providing a plurality of percussion beater cages juxtaposed for the first acoustical trigger (5) and the second acoustical trigger (6) of each of the plurality of the percussion beater cages for being beat selectively by foot-actuation of a single foot pedal (7) having a beat connector (36) articulated for actuating the beater rod (8) of each of the plurality of the percussion beater cages predeterminedly.

The foot pedal (7) for beating the first acoustical trigger (5) on the first cage bar (1) and the second acoustical trigger (6) on the second cage bar (2) can be made adjustable for selectively single-action beating and double-action beating by the beater head (9) for single-action beating and double-action beating of the first acoustical trigger (5) and the second acoustical trigger (6) selectively.

Figure 11:
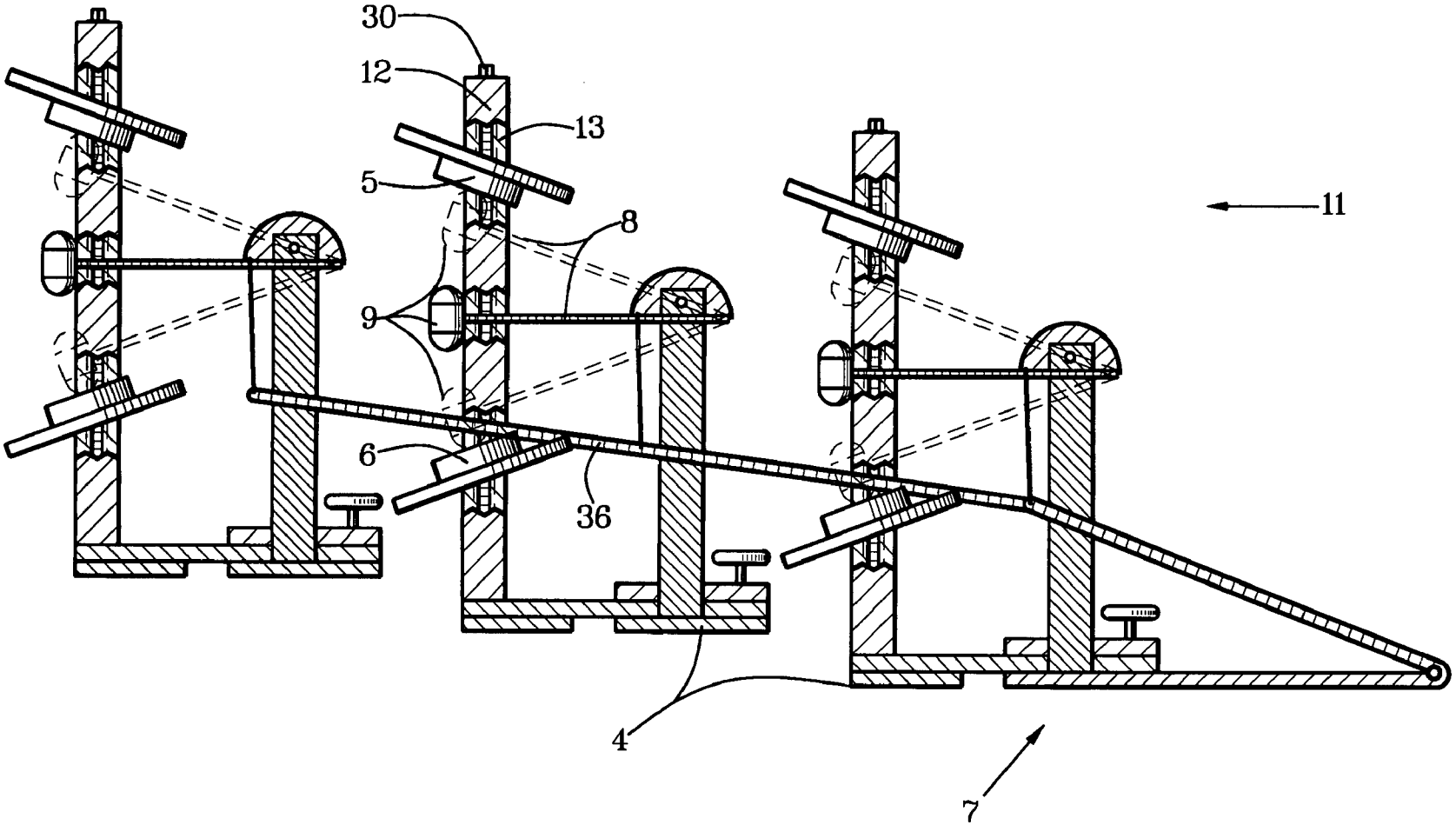
FIG. 11 is a partially cutaway side view of a plurality of the vertical percussion beater cages with the fastener apertures and the two-way adjuster juxtaposed with a beat connector for foot-activating beater rods of the plurality of the vertical percussion beater cages.
Figure 12:
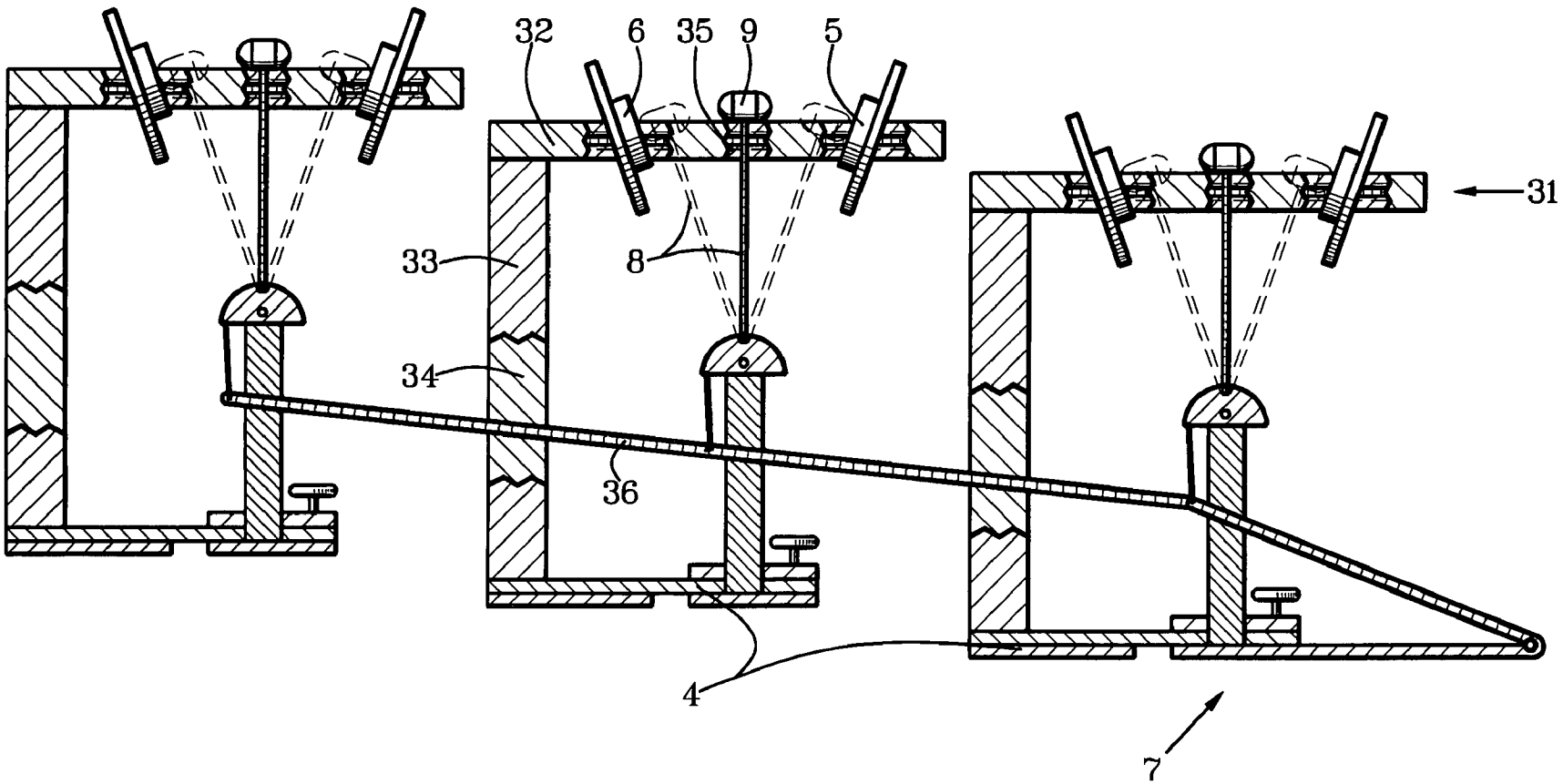
FIG. 12 is a partially cutaway side view of a plurality of the horizontal percussion beater cages with the fastener apertures and the two-way adjuster juxtaposed with a beat connector for foot-activating beater rods of the plurality of the horizontal percussion beater cages.

As shown in FIGS. 11-12, a plurality of percussion beater cages can be juxtaposed for the first acoustical trigger (5) and the second acoustical trigger (6) of each of the percussion beater cages being beat selectively by foot-actuation of a single foot pedal (7) having a beat connector (36) articulated for actuating the beater rod (8) of each of the plurality of percussion beater cages predeterminedly.

The foot pedal (7) for the second acoustical trigger (6) on the second cage bar (2) can be adjusted for preventing being struck by the beater head (9) selectively for single-action beating of the first acoustical trigger (5).

A new and useful percussion beater cage having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. A percussion beater cage comprising:

a first cage bar (1) and a second cage bar (2) spaced apart horizontally and attached orthogonally to at least one bar holder (3);

the bar holder (3) being attached predeterminedly to a horizontal base plate (4);

the first cage bar (1) being structured for attachment of a first acoustical trigger (5);

the second cage bar (2) being structured for attachment of a second acoustical trigger (6);

the base plate (4) being structured for attachment of a predetermined foot pedal (7) for actuating a beater rod (8) having a beater head (9) intermediate positions for the first acoustical trigger (5) and the second acoustical trigger (6) on the first cage bar (1) and the second cage bar (2) respectively;

a bar adjuster (10) structured for adjusting distance between the first cage bar (1) and the second cage bar (2);

the percussion beater cage includes a vertical cage (11) having a first vertical holder (12) and a second vertical holder (13) spaced apart vertically and attached orthogonally to the base plate (4);

the first cage bar (1) and the second cage bar (2) are spaced apart horizontally and attached orthogonally to the first vertical holder (12) and to the second vertical holder (13);

the bar adjuster (10) includes a first-end fastener (14) on the first vertical holder (12) and a second-end fastener (15) on the second vertical holder (13);

the first-end fastener (14) is structured for positioning first ends of the first cage bar (1) desired distances from first ends of the second cage bar (2);

the second-end fastener (15) is structured for positioning second ends of the first cage bar (1) desired distances from second ends of the second cage bar (2);

the first-end fastener (14) includes a first T-slot (16) for receiving first T-members (17) on the first ends of the first cage bar (1) and on the first ends of the second cage bar (2); and the second-end fastener (15) includes a second T-slot (18) for receiving second T-members (19) on the second ends of the first cage bar (1) and on the second ends of the second cage bar (2).

2. The percussion beater cage of claim 1 in which:

the first-end fastener (14) includes a spaced-apart plurality of first fastener apertures (20) for receiving first fastener members (21) on the first ends of the first cage bar (1) and on the first ends of the second cage bar (2); and the second-end fastener (15) includes a spaced-apart plurality of second fastener apertures (22) for receiving second fastener members (23) on the second ends of the first cage bar (1) and on the second ends of the second cage bar (2).

3. The percussion beater cage of claim 1 in which:

the bar adjuster (10) includes a two-way adjuster (24) positioned predeterminedly on the first cage bar (1) and the second cage bar (2);

the two-way adjuster (24) includes a counter-threaded bolt (25) having first-directional bolt threads (26) in threaded contact with first-directional hole threads (27) in the first cage bar (1);

the counter-threaded bolt (25) has second-directional bolt threads (28) in threaded contact with second-directional hole threads (29) in the second cage bar (2); and the counter-threaded bolt (25) has a rotator connection (30) for attachment of motorized and manual rotators selectively.

4. The percussion beater cage of claim 1 in which:

the percussion beater cage includes a horizontal cage (31) having a first horizontal holder (32) with a first end attached to a first upright (33); the horizontal cage (31) has a second horizontal holder (35) with a first end attached to the second upright (34);

the first upright (33) and the second upright (34) are attached to the base plate (4);

the first cage bar (1) and the second cage bar (2) are spaced apart horizontally and attached orthogonally to the first horizontal holder (32) and to the second horizontal holder (35);

the bar adjuster (10) includes the first horizontal holder (32) and the second horizontal holder (35);

the first horizontal holder (32) is structured for positioning first ends of the first cage bar (1) desired distances from first ends of the second cage bar (2);

the second horizontal holder (35) is structured for positioning second ends of the first cage bar (1) desired distances from second ends of the second cage bar (2);

the first horizontal holder (32) includes the first T-slot (16) for receiving the first T-members (17) on the first ends of the first cage bar (1) and on the first ends of the second cage bar (2); and the second horizontal holder (35) includes the second T-slot (18) for receiving the second T-members (19) on the second ends of the first cage bar (1) and on the second ends of the second cage bar (2).

5. The percussion beater cage of claim 4 in which:

the first horizontal holder (32) includes the spaced-apart plurality of the first fastener apertures (20) for receiving the first fastener members (21) on the first ends of the first cage bar (1) and on the first ends of the second cage bar (2); and the second horizontal holder (35) includes the spaced-apart plurality of the second fastener apertures (22) for receiving the second fastener members (23) on the second ends of the first cage bar (1) and on the second ends of the second cage bar (2).

6. The percussion beater cage of claim 5 in which:

the two-way adjuster (24) includes the counter-threaded bolt (25) having the first-directional bolt threads (26) in threaded contact with the first-directional hole threads (27) in the first cage bar (1);

the counter-threaded bolt (25) has the second-directional bolt threads (28) in threaded contact with the second-directional hole threads (29) in the second cage bar (2); and the counter-threaded bolt (25) has the rotator connection (30) for attachment of motorized and manual rotators selectively.

7. A method having the following steps for adjusting a percussion musical instrument for rate per time of foot-actuation:

providing a two-way adjuster (24) predeterminedly on a first cage bar (1) and a second cage bar (2);

the two-way adjuster (24) including a counter-threaded bolt (25);

the counter-threaded bolt (25) having first-directional bolt threads (26) in threaded contact with first-directional hole threads (27) in the first cage bar (1);

the counter-threaded bolt (25) having second-directional bolt threads (28) in threaded contact with second-directional hole threads (29) in the second cage bar (2);

providing the counter-threaded bolt (25) with a rotator connection (30) for attachment of motorized and manual rotators selectively; and rotating the counter-threaded bolt (25) with a rotator connection (30) for adjustment of the rate per time of foot-actuation.

8. The method of claim 7 (and further comprising:

positioning the first cage bar (1) and the second cage bar (2) a predeterminedly adjustable distance apart horizontally on a percussion beater cage;

positioning a first acoustical trigger (5) on the first cage bar (1) and a second acoustical trigger (6) on the second cage bar (2);

positioning a beater head (9) of a beater rod (8) for beating the first acoustical trigger (5) and the second acoustical trigger (6) consecutively by foot-actuating a foot pedal (7) attached to a base plate (4) of the percussion beater cage;

decreasing distance between the first cage bar (1) and the second cage bar (2) to decrease distance between the first acoustical trigger (5) and the second acoustical trigger (6) for increasing rate per time of striking the first acoustical trigger (5) and the second acoustical trigger (6) by rotating the counter-threaded bolt (25) in a first rotational direction; and increasing distance between the first cage bar (1) and the second cage bar (2) to increase distance between the first acoustical trigger (5) and the second acoustical trigger (6) for decreasing rate per time of striking the first acoustical trigger (5) and the second acoustical trigger (6) by rotating the counter-threaded bolt (25) in a second rotational direction.

9. The method of claim 8 and further comprising:

providing a plurality of percussion beater cages juxtaposed for the first acoustical trigger (5) and the second acoustical trigger (6) of each of the plurality of the percussion beater cages for being beat selectively by foot-actuation of a single foot pedal (7) having a beat connector (36) articulated for actuating the beater rod (8) of each of the plurality of the percussion beater cages predeterminedly.

10. The method of claim 9 and further comprising:

the foot pedal (7) for beating the first acoustical trigger (5) on the first cage bar (1) and the second acoustical trigger (6) on the second cage bar (2) being made adjustable for selectively single-action beating and double-action beating by the beater head (9) for single-action beating and double-action beating of the first acoustical trigger (5) and the second acoustical trigger (6) selectively.

11. The method of claim 8 and further comprising:

the foot pedal (7) for beating the first acoustical trigger (5) on the first cage bar (1) and the second acoustical trigger (6) on the second cage bar (2) being made adjustable for selectively single-action beating and double-action beating by the beater head (9) for single-action beating and double-action beating of the first acoustical trigger (5) and the second acoustical trigger (6) selectively.

* * * * *